United States Patent [19]

Hills

[11] 4,265,385

[45] May 5, 1981

[54] MANUAL STOCK FEEDER

[76] Inventor: Robert A. Hills, P.O. Box 152, Rincon, Ga. 31326

[21] Appl. No.: 57,393

[22] Filed: Jul. 13, 1979

[51] Int. Cl.[3] ..... B21D 43/18

[52] U.S. Cl. ..... 226/127; 226/150; 226/162; 192/131 R; 72/422; 83/277

[58] Field of Search ..... 72/422; 113/113 R, 113 A; 83/249, 277; 226/127, 128, 150, 162; 192/131 R

[56] References Cited

U.S. PATENT DOCUMENTS

| | | | |
|---|---|---|---|
| 1,688,197 | 10/1928 | Mayer | 226/127 |
| 2,505,612 | 4/1950 | Ericson | 226/128 |
| 2,701,043 | 2/1955 | Scott | 192/131 R |
| 2,801,608 | 8/1957 | Peck | 226/127 |
| 3,512,438 | 5/1970 | Burdge | 83/277 |

OTHER PUBLICATIONS

"Dickerman Air Feed" Brochure, 11/1974.

*Primary Examiner*—Lowell A. Larson
*Attorney, Agent, or Firm*—Phillips, Hart & Mozley

[57] ABSTRACT

A manual stock feeder apparatus for feeding stock to a machine for processing said stock, said manual stock feeder having a moveable carriage capable of engaging a length of linear stock and capable of sliding along a plurality of parallel linear guide members toward said machine while engaging such length of linear stock and thereby feeding such linear stock into the machine for processing said stock. The apparatus further includes a second stock engagement means for engaging and securing the stock while the carriage 4 is being repositioned to its initial starting place to resume the feeding of stock to the machine for processing said stock.

12 Claims, 4 Drawing Figures

MANUAL STOCK FEEDER

BACKGROUND OF THE INVENTION

The present invention relates to the art of manually feeding linear stock into a machine for processing such linear stock. More specifically, the present invention relates to the art of feeding long thin pieces of lightweight metal into a pneumatic metal punch press machine.

Traditionally, long thin pieces of lightweight metal have been manually fed into pneumatic punch press machines by the metal punch press machine operator. The operator of the metal punch machine would manually feed successive lengths of the thin lightweight metal into the punch press machine after completion of each successive punch operation. The feeding operation was done relatively quickly because the operator could operate the punch press machine with one hand and manually feed further lengths of stock into the punch press machine with the other hand.

Of course, the traditional process of manually feeding stock into a pneumatic punch press machine was often hazardous since the hand which the operator was using to feed the metal into the punch press machine was often in close proximity to the metal punch press during the press operation. In recognition of such hazard, safety standards have recently been promulgated which require that punch press machines be inoperable while the operator's hand is in close proximity to the metal punch. Accordingly, many manufacturers of metal punch press machines now design such machines to require the operator to push two buttons which are remotely located from the area of operation of the punch press, one button with each hand, in order to initiate the operation of the punch press machine, and in order to prevent the operator from operating the machine with one hand while the other hand is in the area of the operating press.

While such design feature has contributed to the safe operation of such punch press machines, such design feature also introduces additional hand movements into the operation of the punch press machine since the operator's hand must be moved from the vicinity of the punch where the stock is loaded to the remotely located button on the punch press for each successive punch operation. This additional hand motion between each successive operation of the punch press significantly limits the efficiency and speed by which such punch press operations can be performed.

Of course, the efficiency of the punch press operation can be enhanced by providing a fully automatic stock feeder which automatically feeds stock into the punch machine after each successive punch operation. However, such automatic stock feeders are often expensive to purchase and install. Further, the set-up time and change-over time of the automatic stock feeder machine is often substantial. Accordingly, the automatic stock feeder is not well adapted for many small businesses and for short run punch press operations.

SUMMARY OF THE INVENTION

The present invention is a manual stock feeder which enables a machine operator to engage a length of linear stock and to manually feed such length of linear stock into a machine for processing said stock without bringing the machine operator's hands into close proximity with the moving parts involved with the machine operation.

It is a further objective of the present invention to provide a manual stock feeder which combines an apparatus according to the present invention for manually feeding a length of stock into a machine, with the control for initiating the operation of such machine in order to eliminate wasted hand motion on the part of the machine operator.

A still further objective of the present invention is to provide a manual stock feeder which is quickly and easily adaptable to different lengths and sizes of stock and to different stock processing operations.

An additional objective of the present invention is to provide a manual stock feeder which may be readily combined with pnuematic punch press machines of conventional design, and which is not expensive to construct, maintain or operate.

The foregoing objectives and still further objectives of the present invention will become apparent from the consideration of the following Description of a Preferred Embodiment, and consideration of the attached Drawings in wnich the numbered parts described in the Description of a Preferred Embodiment are shown by like numbered parts in the accompanying drawings.

DETAILED DESCRIPTION OF A PREFERRED EMBODIMENT

It will be understood that the following Description of a Preferred Embodiment is a description of only one exemplary embodiment of the present invention. The following Description of a Preferred Embodiment is not intended to be an exhaustive description of all of the alternative embodiments of the present invention, and it will be understood that the scope of the present invention and the alternative embodiments encompassed thereby is limited only by the appended claims.

Figure 2:
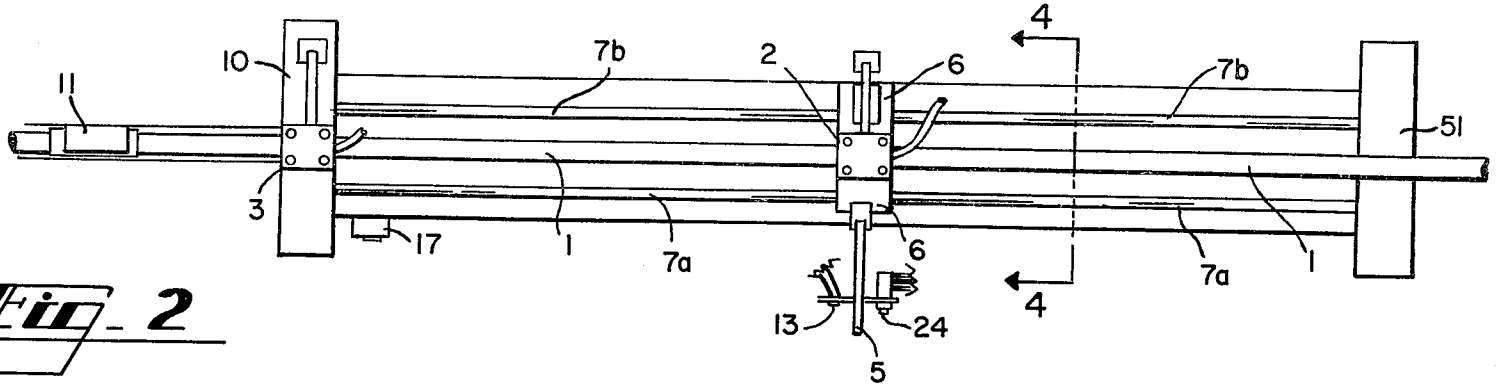
FIG. 2 is a plan view of the same preferred embodiment of the present invention.
Figure 1:
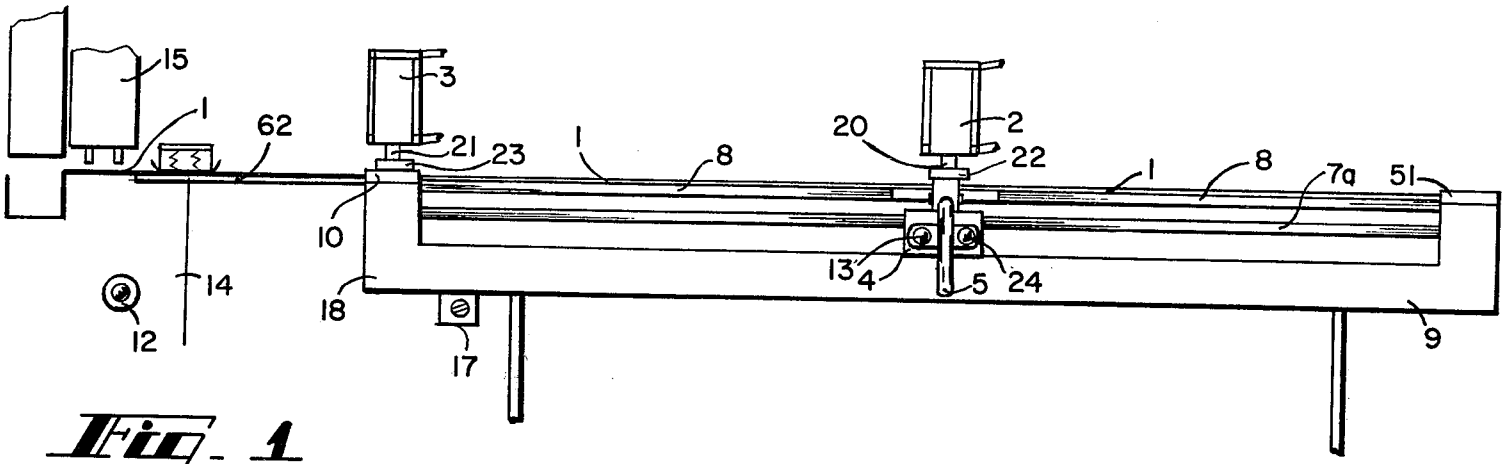
FIG. 1 is a side view of one preferred embodiment of the present invention.

As shown in FIGS. 1 and 2, the preferred embodiment of the manual stock feeder includes a support structure for aligning and supporting the linear stock 1 being fed into the machine. The support structure includes a plurality of parallel horizontal cylindrical guide members, *7a* and *7b*, and at least one longitudinal stock support member 8, all of which are longitudinally aligned in the direction in which the stock 1 travels as it is being introduced into the machine 14. The support structure further includes an end plate 18 which supports the ends of the cylindrical guide members, *7a* and *7b*, and longitudinal stock support member 8, closest to the machine 14 and end plate 9 which supports the ends of the cylindrical guide members, *7a* and *7b*, and longitudinal stock support member 8, situated furthest from the machine 14.

Additionally, a pair of laterally displaced feed plates 10 are adjustably affixed to the top of the end plate 18 such that the lateral displacement of the feed plates 10 on both sides of the line of travel of the stock 1 as it is fed into the machine may be adjusted to conform to the width of the stock 1 in order to provide final lateral alignment of the linear stock 1 as it is introduced into the machine 14. Similarly, an adjustable or interchangeable guide plate 51 may be mounted on the top of end plate 9. The guide plate 51 may be adjusted or should be selected to have a guide slot of equal width with the width of the linear stock 1 in order to accomodate the linear stock 1 and to provide initial lateral alignment to the stock 1 as it is fed into the manual stock feeder.

Figure 4:
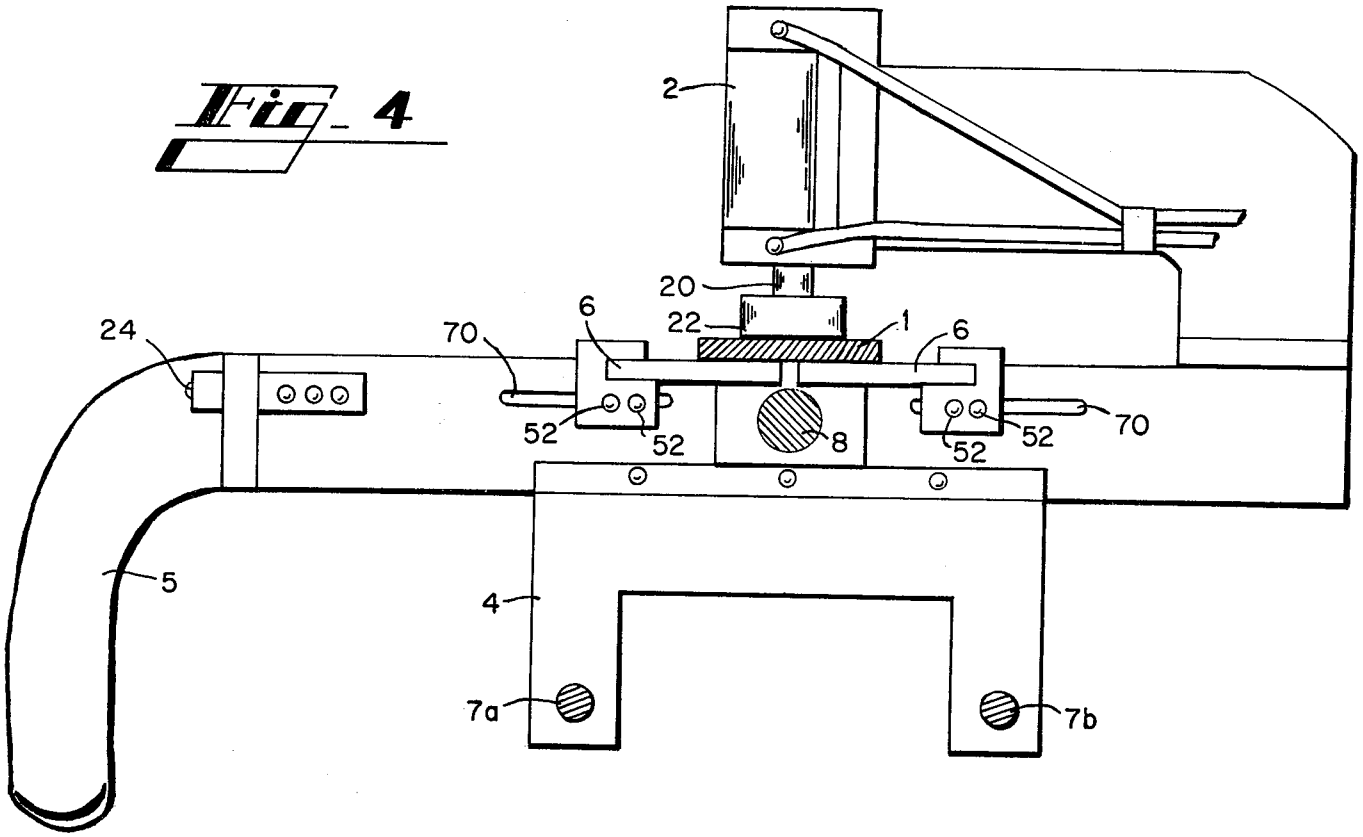
FIG. 4 is a section view of the same preferred embodiment of the present invention, which section view is taken along lines 4—4 of FIG. 2.

As shown most clearly in FIG. 4, the preferred embodiment further includes a carriage 4 which is moveably carried by the cylindrical guide members, *7a* and *7b*, which cylindrical guide members, *7a* and *7b*, guide the travel of the carriage 4 in a direction aligned with the direction in which the stock 1 is to be fed into the machine 14. The carriage 4 further includes a handle 5 to facilitate the manual movement of the carriage 4 along the cylindrical guide members *7a* and *7b*.

Adjustably affixed to the top of carriage 4 is a pair of horizontal stock support plates 6 laterally displaced on both sides of cylindrical member 8. The lateral displacement of the pair of horizontal stock support plates 6 may be adjusted by sliding the plates 6 further apart or closer together to accomodate stock of varying widths. Such adjustment is made by sliding the pair of plates 6 in the mounting slots 70 in the carriage 4 and securing the pair of plates by tightening the adjustment bolts 52 once the pair of plates 6 has been adjusted to the desired lateral displacement. The pneumatic cylinder 2 carries a piston 20. As will be described more fully below, when the piston 20 is in the extended position, the linear stock is engaged and held between the pair of laterally displaced horizontal stock support plates 6, and the pad 22 affixed to the lower end of piston 20.

Referring now to FIGS. 1 and 2, the preferred embodiment also includes a second stock engagement means which includes a pneumatic cylinder 3 which is rigidly affixed to the end plate 18 and is centrally located above and between the pair of feed plates 10. The cylinder 3 carries a piston 21 and, as will be more fully described below, is situated such that when the piston 21 is extended, the stock 1 is engaged and held between the pad 23 at the lower end of the piston 21, the pair of feed plates 10, and the end plate 18.

In the preferred embodiment described herein, the first and second stock engagement means include pneumatically operated pistons 20 and 21, respectively. It will be understood, however, that in alternative embodiments of the present invention, such stock engagement means may include pistons or other means for engaging the stock which are mechanically, electrically, or hydraulically powered, or which are powered by any other suitable source of motive force, and the scope of the invention is not necessarily limited by the source of power to the first and second stock engagement means.

Figure 3:
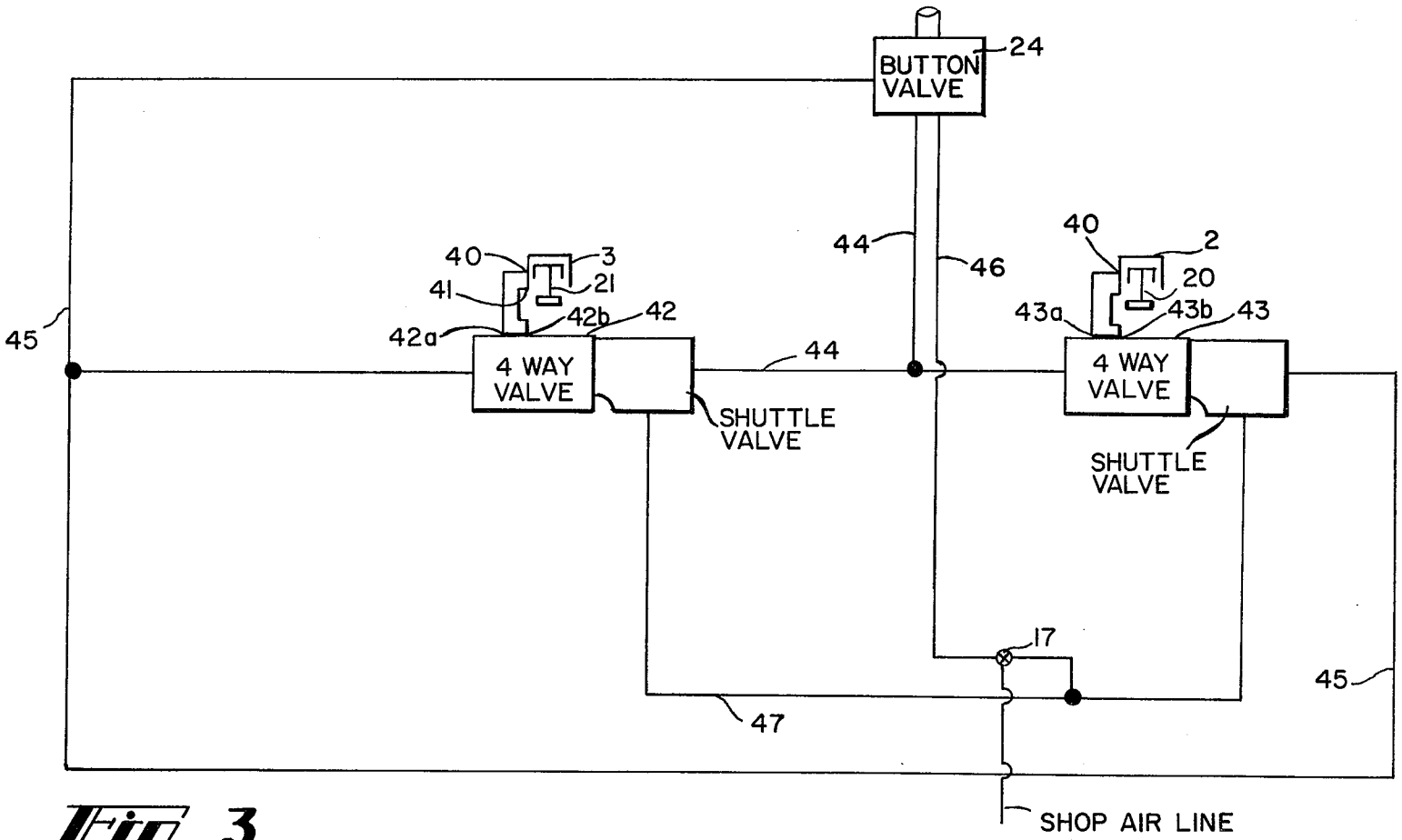
FIG. 3 is a schematic diagram of the pneumatic control system of the same preferred embodiment of the present invention.

Referring now to FIG. 3, the pistons 20 and 21 are carried within air cylinders 2 and 3, respectively. The pistons are each equipped with an upper air inlet 40 and a lower air inlet 41. While any suitable commercially available air cylinder and piston assembly may be used in the present invention, it has been found that the Triple A Cylinder Model No. 120, having a two inch stroke and manufactured by Advance Automation, Chicago, Ill., is suitable for use in the preferred embodiment described herein.

As also shown in FIG. 3, the upper air inlet 40 and the lower air inlet 41 of each of the cylinders 2 and 3 are pneumatically connected to individual four-way slide valves, 43 and 42, respectively. The upper air inlet 40 of cylinder 2 is pneumatically connected to port 42*a* and the lower inlet 41 of cylinder 2 is pneumatically connected to port 42*b*. The upper air inlet 40 of cylinder 3 is connected to port 43*a* and the lower air inlet 41 of cylinder 3 is pneumatically connected to port 43*b*.

The opposite control or pilot ports of the four way slide valves, 42 and 43, are pneumatically connected by lines 44 and 45, such that air pressure on either line 44 or 45 will produce air pressure at the opposite control or pilot ports of the four way slide valves, 42 and 43, and will cause four way slide valves 42 and 43 to be placed in the opposite condition.

In this manner, air pressure on line 44 will cause the four way valve 42 to be placed in condition to provide pneumatic pressure through port 42*b* which will cause the piston 21 to be in the raised position, while at the same time the air pressure on line 44 will also cause the four way valve 43 to be placed in condition to provide pneumatic pressure through port 43*a* which will cause the piston 20 to be in the lowered position.

Conversely, air pressure on line 45 will cause the four way valve 42 to be placed in condition to provide pneumatic pressure through port 42*a* which will cause the piston 21 to be in the lowered position, and at the same time air pressure on line 45 will also cause the four way valve 43 to be placed in condition to provide pneumatic pressure through port 43*b* which will cause piston 20 to be in the raised position.

Button valve 24 provides a means for alternatively placing air pressure on lines 44 and 45, thereby providing a means for controlling the alternative engagement and disengagement of pistons 20 and 21 with respect to the stock 1. Button valve 24 is mounted on the carriage 4 and is pneumatically connected between lines 44 and 45 such that air pressure is either placed on line 45 when the button valve 24 is in the open position or air pressure is placed on line 44 when the button valve 24 is in the pushed or closed position. Thus, when button valve 24 is open, piston 21 is in the raised position out of engagement with the stock 1, and piston 20 is in the lowered position in engagement with the stock 1. Alternatively, when button valve 24 is closed, piston 21 is in the lowered position in engagement with the stock 1, and piston 20 is in the raised position out of engagement with the stock 1.

Air pressure to button valve 24 and thence to the pneumatic circuit described above is provided through line 46 from cross-over valve 17. However, cross-over valve 17 may also be shifted to remove the air pressure supplied by the shop line 48 from line 46, and therefore from button valve 24, and to place the air pressure supplied by the shop line 48 to line 47. As shown in FIG. 3, air pressure on line 47 places air pressure on the pilot ends on the same sides of four way slide valves 42 and 43, such that both valves 42 and 43 are placed in condition to provide air pressure through ports 42*b* and 43*b* to the lower air inlets 41 of the cylinders 3 and 2 respectively, causing both pistons 21 and 20 to be in the raised position when a cross-over valve 17 is shifted in the manner described. Thus, the cross-over valve 17 provides a means for controlling the pistons 20 and 21 and for placing both pistons 20 and 21 in the raised position out of engagement with the stock at the same time.

As shown in FIG. 1, the first stock engagement control means for the preferred embodiment described herein, button valve 24, is mounted on the carriage 4. The second stock engagement control means described herein, cross-over valve 17, may be mounted at a position remote from the carriage, such as the position on the stock feeder beneath the end plate 18, as shown in FIG. 1.

The preferred embodiment further includes a control 13 which is in pneumatic communication with the control system of the punch press machine 14. As adapted for righthanded operation as shown in the preferred embodiment herein, the control button 13 is pneumatically connected to the control or palm button which is ordinarily operated by the left hand of the operator of the machine 14. As will be described more fully below, the location of such control 13 on the carriage 4 enables the machine operator to initiate and otherwise control the operation of the machine 14 without removing his right hand from the handle 5, thereby eliminating any requirement that the machine operator move his right hand back from the carriage 4 to the machine 14 in order to initiate or control the operation of the machine 14 after feeding each successive length of stock.

As shown in FIG. 1 and FIG. 2, the pair of feed plates 10 mounted on end plate 18 provide a recessed channel in which the stock 1 slides as it is introduced to the machine 14, thereby properly aligning the stock 1 as it is introduced into the machine 14. In the preferred embodiment shown herein, the machine 14 is a punch press machine having a punch 15 which is pneumatically powered and which is capable of first making the necessary punches in the stock which has been introduced into the machine, and then separating the punched length of stock during the next successive operation of the punch press machine.

The preferred embodiment shown herein may be adapted for use with linear stock 1 having an overall length in excess of the length of the manual stock feeder. The excess length of such stock 1 which extends beyond support 9 and guide plate 51 may be supported by a plurality of rollers or other suitable supports of conventional design.

The preferred embodiment of the present invention shown herein also includes a spring-loaded finger 11 which provides a third stock engagement means. The spring-loaded finger 11 is attached to the machine 14 immediately ahead of the punch 15 and the pressure from the spring-loaded finger 11 maintains such spring-loaded finger 11 in engagement with the stock 1 as it travels into the machine 14. In this manner, the stock 1 is prevented from riding up and out of the recess 62 between the pair of guide plates 10 and the punch 15 as the stock 1 approaches the punch 15.

In order to operate the preferred embodiment of the stock feeder apparatus disclosed herein, both pistons 20 and 21 are placed in the raised position by closing cross-over valve 17. The linear stock 1 is then fed through the properly adjusted guide plate 51, along the length of the stock feeder over stock support member 8, over the properly adjusted laterally displaced horizontal stock support plates 6 on carriage 4, and through the pair of feed plates 10, and into the alignment recess 62, and then into position on the machine 14. Once the stock 1 is properly in position relative to the punch 15, the valve 17 is opened thereby lowering piston 20 into engagement with the stock 1.

The next step in the operation of the stock feeder is the positioning of the carriage 4 at the initial starting point on the stock feeder apparatus. Such positioning is accomplished by pushing the button valve 24 which causes the piston 20 to retract from engagement with the stock 1, and causes piston 21 to lower to engage the stock 1 at the feed plate 10. The carriage 4 is then moved along the cylindrical guide members 7*a* and 7*b* to the end of the stock feeder apparatus away from the feed plate 10. Once the carriage 4 is positioned at the end of the stock feeder apparatus away from the feed plate 10, the button valve 24 is released causing the piston 20 to engage the stock 1 and causing the piston 21, which had been holding the stock in place while the carriage 4 was being positioned, to raise and disengage from the stock 1.

Once the carriage 4 has been positioned to begin feeding stock as described above, the operation of the punch press machine is initiated by the operator pushing the right hand control button 12 on the punch press machine with his left hand and by operating the left hand control button on the machine 14 by pushing the control button 13 which is mounted on the carriage 4 with his right hand.

Once the operation of the machine 14 has been initiated and completed, the machine is then ready to receive the next length of stock 1. Such next length of stock is fed to the machine by moving the carriage 4 along the cylindrical guide members 7*a* and 7*b* toward the machine, thereby sliding a second length of the stock 1 along stock support member 8 into the machine 14. Once the second length of stock 1 has been moved into position in the machine 14, the machine 14 is again operated by the machine operator pushing the button 12 on the machine with his left hand and the button 13 on the carriage with his right hand.

After the machine 14 has completed its punch operation with respect to the second length of stock 1, a third length of stock 1 is moved into position by moving the carriage 4 along the cylindrical guide members 7*a* and 7*b* toward the machine 14 until such third length of stock 1 is in position. The machine is then operated as described above, and further successive lengths of stock 1 are fed into position following the completion of each operation of the machine 14 by sequentially moving the carriage 4 along the cylindrical members 7*a* and 7*b* toward the machine 14.

Once the carriage 4 has reached the furthest extent of its travel along the cylindrical guide members 7*a* and 7*b* toward the machine 14 and the laterally displaced plates 6 are in abutment with the pair of feed plates 10, the carriage 4 must be again returned to its initial starting position on the stock feeder apparatus. In order to reposition the carriage 4, the button valve 24 is closed causing the piston 20 to retract and the piston 21 to engage the stock 1. The carriage 4 may then be moved along the cylindrical guide members 7*a* and 7*b* back to its initial starting point while the piston 21 engages the stock 1 and prevents the stock 1 from moving out of its position relative to the machine 14. Once the carriage 4 has been repositioned in its initial starting position on the stock feeder apparatus, the stock feeder is again operated in the method described above to feed further lengths of stock 1 into the machine 14 following each successive operation of the machine 14.

In order to abut two lengths of stock 1 into the machine 14, a second piece of stock may be placed on the stock feeder. A spring-loaded finger 11, as previously described, may also be provided, and the finger 11 will engage the stock in order to hold the first piece of stock in position in the recess 62 while the second piece of stock is being fed into the machine behind the first piece of stock.

It will be understood by those skilled in the art that the foregoing Description of a Preferred Embodiment has not been exhaustive of the various alternative embodiments of the present invention, and has been merely illustrative and exemplary of the preferred embodiments of the present invention. It will also be understood that additional embodiments clearly fall within the spirit and scope of the present invention, and that the present invention is limited solely by reference to the appended claims.

What I claim is:

1. A stock feeder apparatus for feeding stock to a machine for processing said stock, including:

(a) A support means for aligning said stock for feeding said stock to said machine and for supporting said stock relative to said machine, said support means including a first end plate at the end of the support means closest to the machine and second end plate at the end of the support means furthest from the machine, and at least one cylindrical member rigidly affixed between said first end plate and said second end plate aligned with the direction of movement of said stock as said stock is being fed to said machine;

(b) a carriage in sliding communication with said cylindrical member, said carriage further including a handle rigidly affixed to said carriage;

(c) a first stock engagement means for mechanically engaging said stock at a first starting point relative to said support means, said first stock engagement means being capable of being moved into engagement with said stock and disengaged from said stock, and said first stock engagement means being carried by said carriage;

(d) a second stock engagement means for mechanically engaging said stock at a second point relative to said support means, said second point being collinearly located with the path of said stock as said stock is fed into said machine, and located between said first starting point and said machine, and said second stock engagement means being capable of being moved into engagement with said stock and disengaged from said stock;

(e) a first stock engagement control means for alternatively moving said first stock engagement means into engagement with said stock and for moving said second stock engagement means into engagement with said stock, said first stock engagement control means being responsive to an actuator means for actuating said first stock engagement control means, and said actuator means being carried by said carriage; and (f) a second stock engagement control means for disengaging both said first stock engagement and said second stock engagement means from said stock.

2. A stock feeder apparatus as claimed in claim 1, wherein said first stock engagement means is capable of being pneumatically moved into engagement with said stock and being pneumatically moved out of engagement with said stock.

3. A stock feeder apparatus as claimed in claim 1, wherein said second stock engagement means is capable of being pneumatically moved into engagement with said stock and being pneumatically disengaged from said stock.

4. A stock feeder apparatus as claimed in claim 1, wherein said first stock engagement means and said second stock engagement means are in pneumatic communication and are both capable of being pneumatically moved into engagement with said stock and being pneumatically disengaged from said stock, and wherein said first stock engagement control means further includes a pneumatic valve pneumatically placed between said first stock engagement means and said second stock engagement means, said pneumatic valve being responsive to said actuator means mounted on said carriage.

5. A stock feeder apparatus as claimed in claim 1, further including:

(g) a control means for controlling the operation of said machine for processing said stock, said control means being mounted on said carriage.

6. A stock feeder apparatus as claimed in claim 1:

(a) wherein said support structure further includes a longitudinal stock support member rigidly affixed between said first end plate and second end plate;

(b) wherein said carriage further includes a first horizontal stock support member and a second horizontal stock support member, said first horizontal stock support member and said second horizontal stock support member being rigidly affixed to said carriage in lateral displacement relative to said longitudinal stock support member and immediately beneath the plane of said stock as said stock is fed into said machine; and (c) wherein said first stock engagement means includes a pneumatically powered cylinder and piston assembly rigidly connected to said carriage such that the piston is capable of being moved into communication with said stock when said stock is carried by said first longitudinal stock support member and by said first and second horizontal support members.

7. A stock feeder apparatus for feeding stock to a machine for processing sections of said stock, including:

(a) a support for aligning said stock for feeding said stock to said machine and for supporting said stock relative to said machine, and further including at least one elongated track member longitudinally aligned with the direction of movement of said stock as said stock is being fed to said machine;

(b) a carriage in moveable communication with said elongated track member over a length of said elongated track member greater than the length of the sections of said stock to be fed into said machine to be processed by each operation of said machine, said carriage further including a handle rigidly affixed to said carriage;

(c) a first stock engagement means for mechanically engaging said stock at a first starting point relative to said support means, said first stock engagement means being capable of being moved into engagement with said stock and disengaged from said stock, and said first stock engagement means being carried by said carriage;

(d) a second stock engagement means for mechanically engaging said stock at a second point relative to said support means, said second point being collinearly located with the path of said stock as said stock is fed into said machine, and located between said first starting point and said machine, and said second stock engagement means being capable of being moved into engagement with said stock and disengaged from said stock;

(e) a first stock engagement control means for alternatively moving said first stock engagement means into engagement with said stock and for moving said second stock engagement means into engagement with said stock, said first stock engagement control means being responsive to an actuator means for actuating said first stock engagement control means, and said actuator means being carried by said carriage; and (f) a second stock engagement control means for disengaging both said first stock engagement and said second stock engagement means from said stock.

8. A stock feeder apparatus as claimed in claim 7, wherein said first stock engagement means is capable of being pneumatically moved into engagement with said stock and being pneumatically moved out of engagement with said stock.

9. A stock feeder apparatus as claimed in claim 7, wherein said second stock engagement means is capable of being pneumatically moved into engagement with said stock and being pneumatically disengaged from said stock.

10. A stock feeder apparatus as claimed in claim 7, wherein said first stock engagement means and said second stock engagement means are in pneumatic communication and are both capable of being pneumatically moved into engagement with said stock and being pneumatically disengaged from said stock, and wherein said first stock engagement control means further includes a pneumatic valve pneumatically placed between said first stock engagement means and said second stock engagement means, said pneumatic valve being responsive to said actuator means mounted on said carriage.

11. A stock feeder apparatus as claimed in claim 7, further including:

(g) a control means for controlling the operation of said machine for processing said stock, said control means being mounted on said carriage.

12. A stock feeder apparatus as claimed in claim 7:

(a) wherein said support structure further includes a first end plate at the end of the support means closest to said machine and a second end plate at the end of the support means furthest from the machine, and including a longitudinal stock support member rigidly affixed between said first end plate and said second end plate;

(b) wherein said carriage further includes a first horizontal stock support member and a second horizontal stock support member, said first horizontal stock support member and said second horizontal stock support member being reigidly affixed to said carriage in lateral displacement relative to said longitudinal stock support member and immediately beneath the plane of said stock as said stock is fed into said machine; and (c) wherein said first stock engagement means includes a pneumatically powered cylinder and postion assembly rigidly connected to said carriage such that the piston is capable of being moved into communication with said stock when said stock is carried by said first longitudinal stock support member and by said first and second horizontal support members.

* * * * *